United States Patent [19]

Craggs

[11] 4,391,571

[45] Jul. 5, 1983

[54] PUMPING APPARATUS FOR PUMPING LIQUIDS SUCH AS SLURRYS

[76] Inventor: Thomas A. Craggs, 49, Pacific Rd., Trentham, Stoke-on-Trent, Staffordshire, England

[21] Appl. No.: 193,188

[22] PCT Filed: Oct. 12, 1979

[86] PCT No.: PCT/GB79/00163

§ 371 Date: Jun. 13, 1980

§ 102(e) Date: Jun. 13, 1980

[87] PCT Pub. No.: WO80/00867

PCT Pub. Date: May 1, 1980

[30] Foreign Application Priority Data

Oct. 14, 1978 [GB] United Kingdom ..... 40592/78

[51] Int. Cl.[3] ..... F04B 17/00

[52] U.S. Cl. ..... 417/403; 91/275; 91/436; 418/88

[58] Field of Search ..... 417/403, 404, 88; 91/436, 275

[56] References Cited

U.S. PATENT DOCUMENTS

| | | | |
|---|---|---|---|
| 2,424,300 | 7/1947 | Becker | 60/376 |
| 2,462,571 | 2/1949 | Thompson et al. | 91/275 |
| 2,582,564 | 1/1952 | Schneck et al. | 60/376 X |
| 2,646,025 | 7/1953 | Deardorff | 91/436 |
| 2,836,122 | 5/1958 | Johnson | 417/403 X |
| 2,955,460 | 10/1960 | Stevens et al. | 91/275 X |
| 3,071,926 | 1/1963 | Olson et al. | 91/436 X |
| 4,119,113 | 10/1978 | Meginniss | 417/404 X |

FOREIGN PATENT DOCUMENTS

| | | | |
|---|---|---|---|
| 2370907 | 6/1978 | France | 91/275 |
| 760600 | 11/1956 | United Kingdom . | |
| 1251024 | 10/1971 | United Kingdom . | |

*Primary Examiner*—Leonard E. Smith

*Attorney, Agent, or Firm*—Merriam, Marshall & Bicknell

[57] ABSTRACT

A pumping apparatus for pumping liquids such as slurrys comprises a pumping cylinder/piston (6,8) driven by the piston/cylinder (16,18) of an operating device, the supply of fluid under pressure either to an upper port (**16*a*) of the cylinder (16), or the lower port (16*b*) of the cylinder, being controlled by valve mechanism (28). The valve mechanism is moved between two conditions, in which it supplies fluid under pressure to one or other of said ports consequent upon the arrival of a member (20) connecting the two pistons (8,18**) at one or other of its extreme positions of movement. Alternatively, or in addition, the fluid pressure circuit powering the operating device includes a regenerative branch, through which fluid under pressure flows from the low pressure side of the operating device directly back to the high pressure line of the fluid circuit, upstream of the motor supplying fluid under pressure. In this manner, the apparatus can operate both at an initial high speed, under relatively low resistance to pumping, while utilizing a power source which is smaller than would otherwise be required. In this manner, not only is a saving of energy obtained, but (because of a reduction of work done on the fluid) water cooling of the fluid circuit may be dispensed with.

12 Claims, 6 Drawing Figures

PUMPING APPARATUS FOR PUMPING LIQUIDS SUCH AS SLURRYS

DESCRIPTION OF INVENTION

This invention is concerned with improvements relating to liquid pumping apparatus.

In, for example, the pumping of liquids such as sewage slurry into a filter press, conventionally there is used apparatus comprising a pumping device, comprising a pumping piston reciprocably mounted in a cylinder to cause slurry to be drawn through an inlet port into a chamber, conveniently afforded by the cylinder, and pumped from the chamber through an outlet port into the filter press. The apparatus also comprises an operating device comprising a drive piston reciprocably mounted in a cylinder and which is connected to the pumping piston by a connecting member, the admission of fluid under pressure to one of two inlet ports of the drive cylinder causing the drive piston, and hence the pumping piston, to move. As the drive piston reaches its uppermost position, it is necessary to operate a valve to reverse the application of fluid pressure to the drive cylinder, and when the drive piston reaches its lowermost position, it is necessary to operate the valve again to reverse the application of fluid under pressure to the drive cylinder.

At present, operation of the valve is effected by a linkage connected to the piston rod, or a cross-head thereof, movement of the linkage to an from its extreme positions effecting switching of the valve in a mechanical operation. Such a method is not only cumbersome, but is also dangerous, in that it is difficult or impractical to fully enclose the moving parts of the apparatus, for example by a safety screen.

According to the invention there is provided apparatus suitable for use in the pumping of a slurry and comprising a pumping device which comprises a cylinder and a piston mounted therein, and which is operative to cause liquid to be drawn through an inlet port and expelled through an outlet port, an operating device comprising a cylinder and piston mounted therein, valve mechanism which is operative to control the admission of fluid under pressure to the cylinder of the operating device, and a connecting member extending between the piston of the pumping device and the piston of the operating device, the apparatus comprising control mechanism which comprises two sensor members respectively responsive to the connector member of a part fixedly secured thereto reaching its two extreme positions of movement, to cause switching of the valve mechanism.

The moving parts of apparatus of the kind set out in the last preceding paragraph may readily be enclosed behind a safety screen, conveniently in the form of a perspex screen, reducing the possibility of injury to personnel supervising operation of the apparatus.

The sensor members may be provided by switches (e.g. micro switches) which are positively actuated by the connector member, or such part fixedly secured thereto. Whereas such switches may form part of a fluid pressure circuit of the control mechanism, to reduce response time, it would, in such circumstances, be necessary to position the control mechanism close to the valve mechanism. Thus, advantageously such switches form part of an electrical circuit of the control mechanism.

Preferably, however, the sensor members are provided by proximity switches responsive to the presence of the connector member, or such part fixedly secured thereto, at the extreme positions of movement, without any mechanical inter-action therebetween. Most conveniently the proximity switches are reed switches which are switched at the extreme positions of movement of the connector member by the proximity of a permanent magnet fixedly secured to the connector member, or a cross-head thereof. However, other forms of proximity switches, such as switches responsive to change in electrical capacitance, may be utilised.

It will of course be appreciated that the sensor members may be so positioned as to be activated immediately prior to the connector member reaching its extreme positions, especially where the control mechanism and/or the valve mechanism operates under a brief time delay. Additionally, it will be appreciated that the term "extreme positions of movement" refer to the extreme positions actually reached by the control member, irrespective of whether or not the control member is capable of further movement in one or both directions.

Alternatively, or in addition, presently available apparatus for pumping liquids such as sewage slurry into a filter press suffers from disadvantages in relation to the difficulty of the pump meeting the different pumping parameters which prevail at different times of a pumping cycle.

For example, at the beginning of a pumping cycle, the resistance of flow of the slurry into the filter press is minimal, and it is thus desirable for the pump to operate at a high a speed as possible. Conversely, towards the end of the pumping cycle, as the filter press fills, resistance to pumping of slurry in to the filter press increases, and the requirement is therefore for the apparatus to pump slurry at a lower rate, at a high pressure. At the end of the cycle, in order to subject the slurry in the filter press to the highest possible pressure, it is desirable to maintain the pump at stall conditions for a short period of time, during which period there is no flow of slurry into the filter press.

A typical existing apparatus, to overcome the problems of significantly varying rates of flow of fluid under pressure during different times of the cycle, uses a motor which is capable of delivering fluid at both high pressure and high flow rates. During the initial part of the cycle, the resistance to pumping movement of the piston is small, and fluid is retained from the low pressure side of the operating device to the sump of the hydraulic circuit. However, as resistance to pumping increases, and the pump demand for fluid under pressure decreases, fluid is returned directly to the sump from the high pressure side of the fluid circuit by way of a dump valve. This necessitates that a considerable amount of work is done on the fluid throughout the cycle, and in general such pumps have power requirements which are excessive in relation to the work which the apparatus is required to do, and it is in general necessary that such pumps comprise cooling circuits for the pressure fluid thereof.

It has been suggested to overcome this problem, that two pumps be provided, one which operates initially at high speed and at low pressure, the second of which operates during a later stage of the pumping cycle at low speed and high pressure. This is however unnecessarily expensive and seems by the present Applicants to be a typical example of the expression "using a sledge hammer to crack a walnut".

Thus, according to this invention there is also provided apparatus for use in the pumping of a slurry and comprising a pumping device comprising a cylinder and a piston mounted therein, and which is operative to cause liquid to be drawn through an inlet port and expelled through an outlet port, an operating device comprising a cylinder and piston mounted therein, a fluid pressure circuit which includes a fluid sump, a motor operative to pump fluid under pressure to the operating device and valve mechanism operative to control the admission of fluid under pressure to the operating device, a connecting member extending between the piston of the pumping device and the piston of the operating device, wherein in each pumping operation of the apparatus, part of the fluid flowing from the low pressure side of the operating device is returned directly to the high pressure side of the fluid circuit and part is returned to the sump of the fluid pressure circuit.

Preferably, the said part of the fluid which is returned directly to the high pressure side of the fluid circuit is returned thereto through a venturi device.

Advantageously, there is provided in the low pressure side of the operating device, a valve which is normally in a first condition in which part of the fluid flowing from the low pressure side of the operating device is returned directly to the high pressure side of the fluid circuit and part is returned to the sump of the fluid circuit, said valve being moved from its first condition to a second condition in consequence of an increase in the pressure of fluid on the high pressure side of the operating device to a predetermined pressure, in which second condition fluid flowing from the low pressure side of the operating device is returned preferentially directly to the sump of the fluid pressure circuit.

Preferably, but not necessarily, the feature set out in the last preceding three paragraphs, is included in apparatus of the kind set out in the last preceding paragraph but twelve.

The invention will become more clear from the following description, to be read with reference to the accompanying drawings in which.

Figure 1:
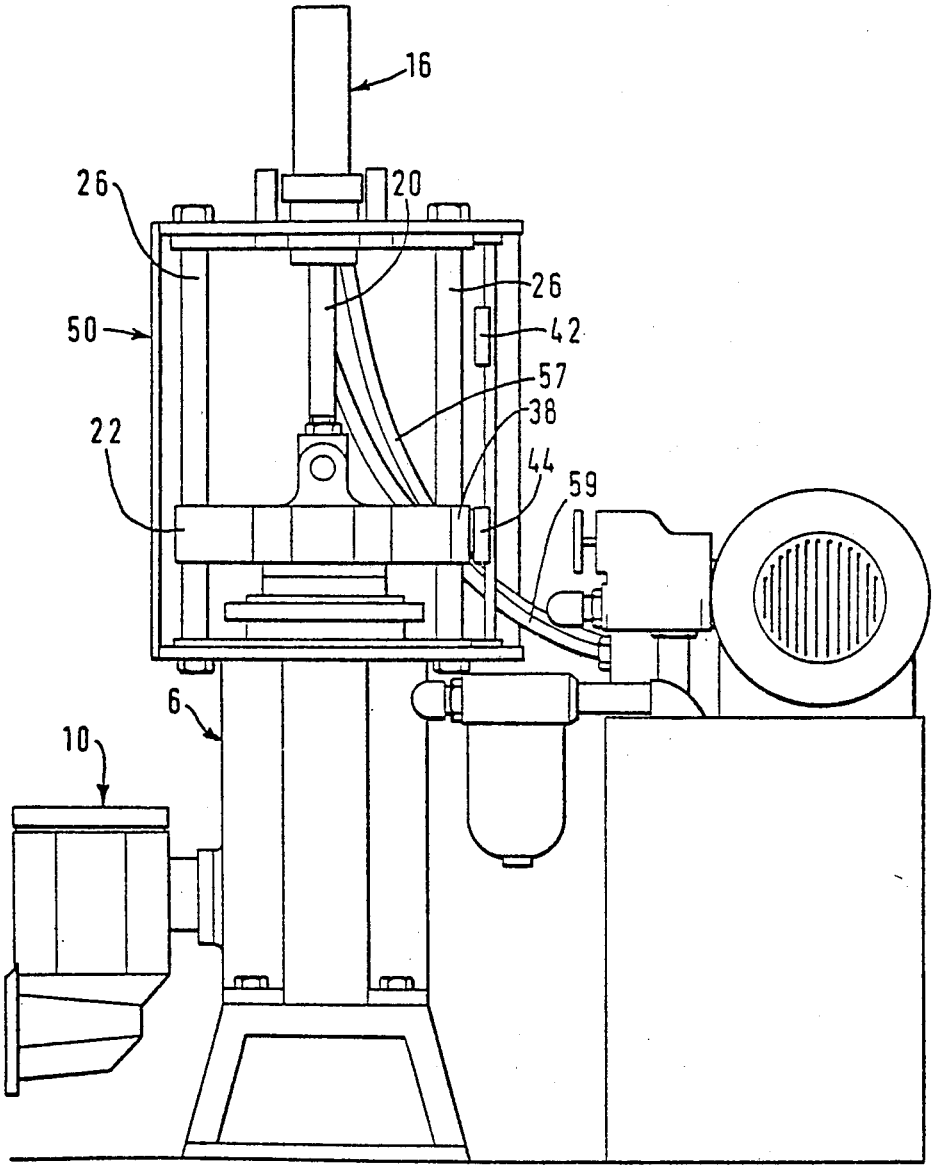
FIG. 1 is a side view of pumping apparatus which is an embodiment of the invention which has been selected to illustrate the invention by way of example.

The apparatus which is the preferred embodiment of this invention comprises a pumping device comprising a cylinder 6, a piston 8 mounted for reciprocating movement in the cylinder 6 to cause liquid (in the preferred embodiment a sewage slurry) to alternately be drawn through an inlet valve 10 into the cylinder chamber 12, and to be forced from the chamber 12 through the outlet valve 14 into filter press (not shown) connected to the outlet valve.

The apparatus also comprises a fluid pressure operating device comprising a cylinder 16 and a drive piston 18, mounted for reciprocating movement in the cylinder 16. A connecting member in the form of a rod 20 extends between the piston 8 and the piston 18, a cross-head 22 being fixedly secured to the connected rod 20.

The cylinder 16 is mounted on a trunnion 24, tie rods 26 passing through apertures in the head 22 guiding the connecting rod for linear, axial movement.

Figure 4:
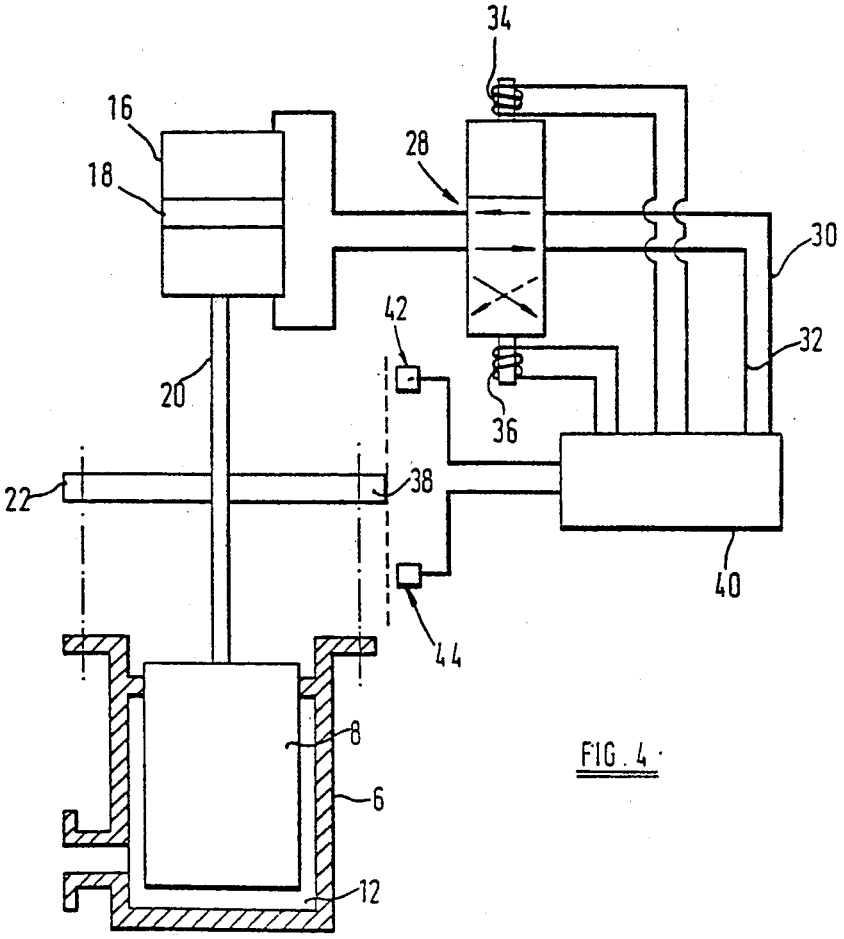
FIG. 4 is a schematic view illustrating part of the control mechanism of the apparatus.

The apparatus also comprises a fluid pressure circuit which includes a fluid sump 27, a motor 26 operative to pump fluid under pressure from the sump 27 to the operating device, and valve mechanism 28 operative to control the admission of fluid under pressure to the cylinder 16 (FIG. 4). The valve mechanism 28 is connected to the motor by a high pressure line 30, and to the sump of the source by a low pressure line 32. The valve mechanism 28 is a bi-stable latch-type valve, being stable in a first position (FIG. 4) in which fluid under pressure is supplied through the valve mechanism to an upper inlet port **16*a* of the cylinder 16 by line 56, a lower inlet port 16*b* thereof being connected via line 58 to the sump, and a second position in which fluid under pressure is supplied to the lower inlet port 16*b* of the cylinder, the upper inlet port 16*a* being connected to the sump. The valve mechanism may be moved from its first to its second position by momentary energisation of a solenoid 34, and from its second position to its first position by momentary energisation of a solenoid 36**.

A pumping operation involving the use of the apparatus involves a series of pumping strokes, in which the upper inlet port of the cylinder 16 is connected to the high pressure line, in which the piston 8 is moved to pump slurry from the cylinder chamber 12 into a filter press, alternating with a series of intake strokes, in which the valve mechanism is in its second position, with the lower inlet port being connected to the high pressure line.

Mounted on the cross-head 22 is a permanent magnet 38, and mounted adjacent to the positions occupied by the magnet at the two extreme positions of movement of the cross-head are upper and lower limit sensors 42, 44 respectively, provided by magnetically operated reed switches. These reed switches form part of control mechanism 40 of the apparatus, adapted to control the application of the fluid under pressure to the cylinder 16 by operation of the valve mechanism 28.

Extending between the lines 32 and 58 is a branch line 60, operative in which is a one-way valve 62. The line 60 extends to the radial port of a venturi device 64, located axially along the high pressure line 30.

Extending from line 58 is a return line 68, which extends directly to the sump (that is, not by way of the valve mechanism 28). Operative across the line 68 is a relief valve 66, which normally adopts a first condition to block the line 68. However, when pressure in the high pressure line 56 reaches a predetermined maximum pressure, this pressure is operative, through line 70, to move the valve 66 from its first condition to a second condition, in which fluid may flow preferentially from the lower port **16*b* of the cylinder 16** directly to the circuit sump.

Figure 5:
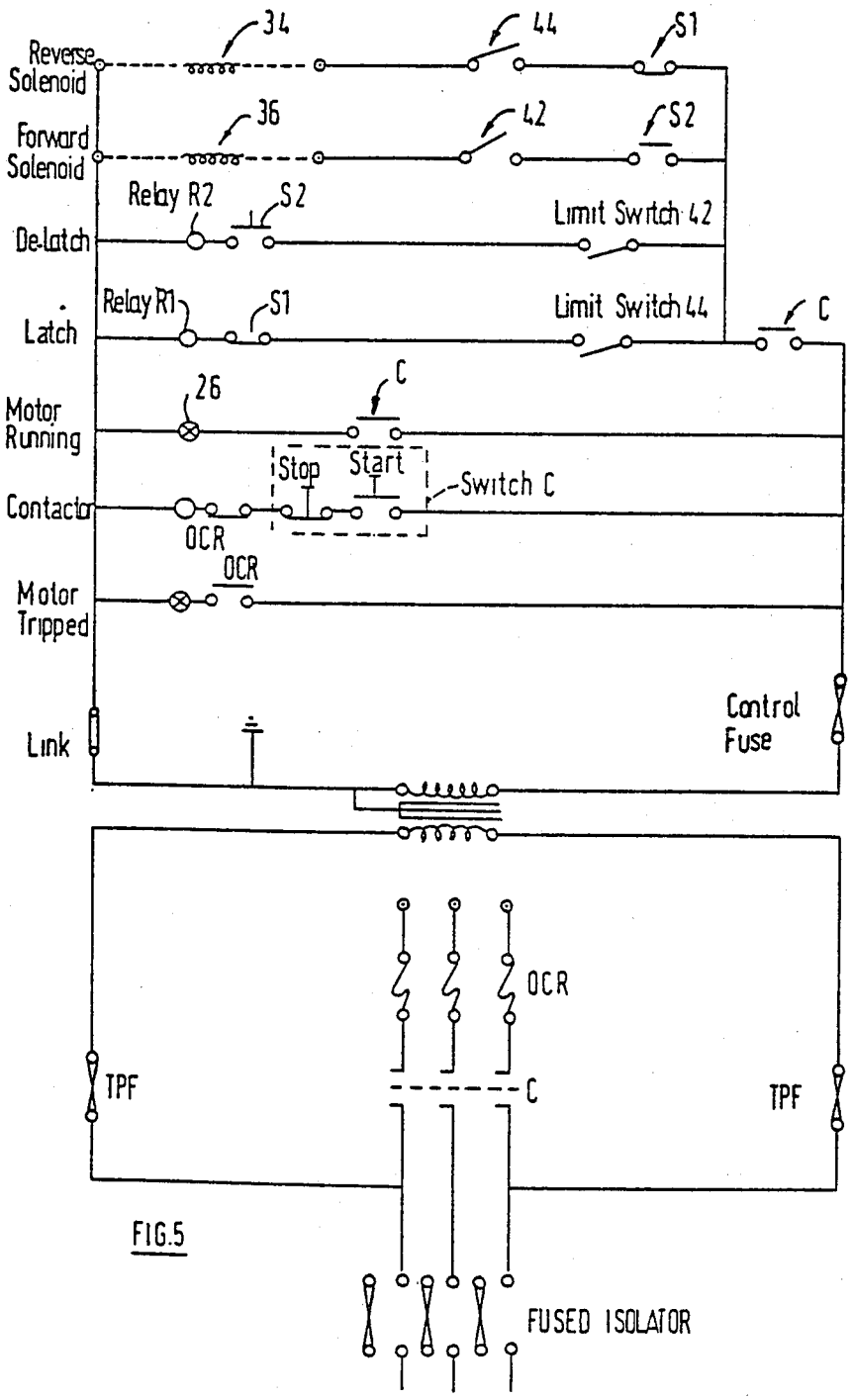
FIG. 5 is an electrical circuit diagram of the control mechanism.

A sequence of operations of the accompanying apparatus will now be described starting from the position shown in FIG. 4 of the drawings, various switches and relays being shown in FIGS. 5 and 6.

Figure 6:
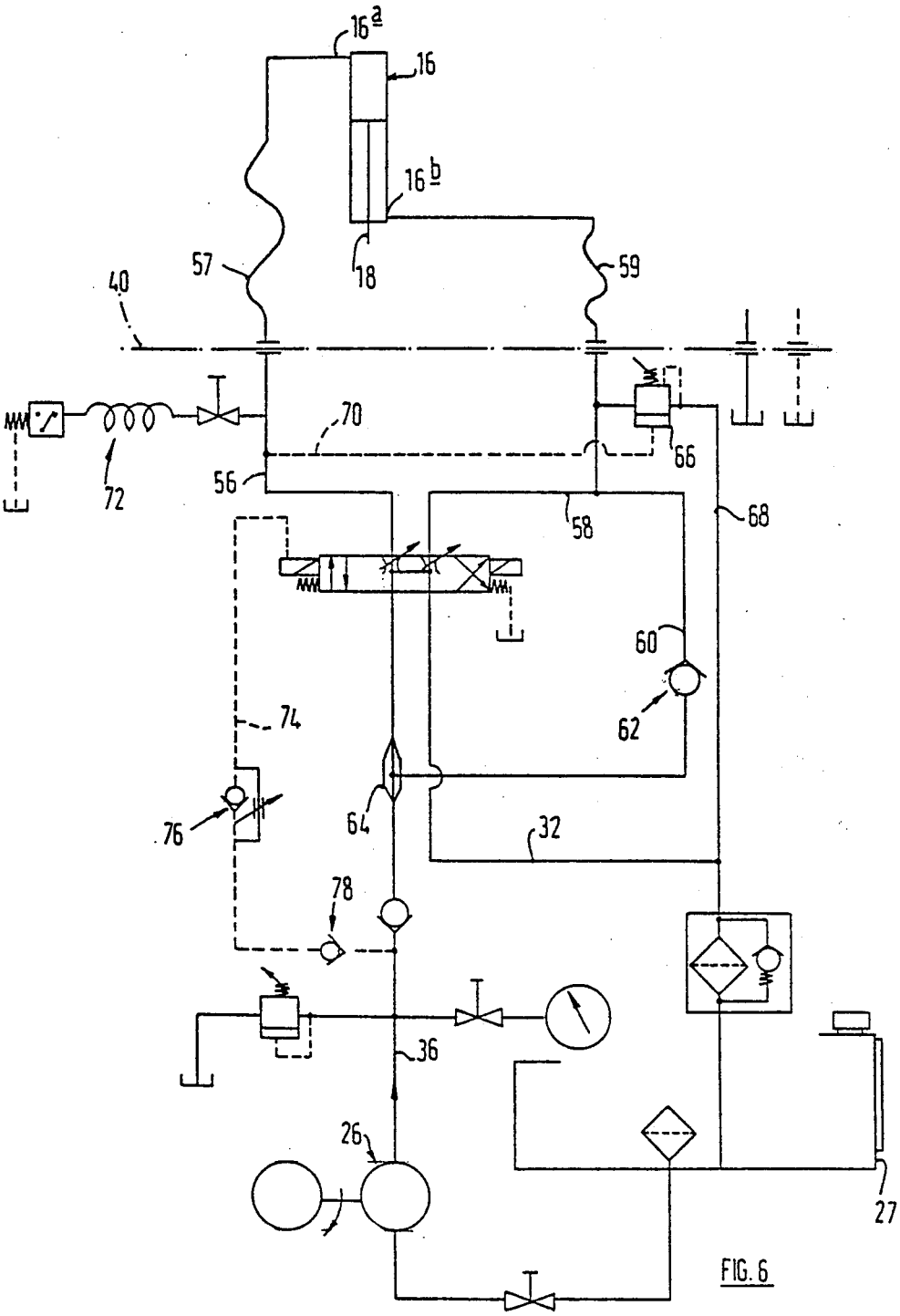
FIG. 6 is a hydraulic circuit diagram of the control mechanism.

Upon closing of the start switch C, with the bi-stable (latch) valve mechanism 28 in its first position shown in FIGS. 4 and 6, fluid under pressure is supplied to the upper inlet port of the cylinder 16, causing the piston thereof to downstroke, causing other liquid with which the cylinder 6 has previously been primed, to be forced from the cylinder chamber 12 through the outlet valve 14.

Fluid displaced by the piston 18 from the cylinder 16 will flow through the lower port 16*b* via line 58, the valve 66 being during this stage of the pumping operation, in its first (closed) condition. A majority of liquid flowing along line 58 will pass through the valve mechanism 28, and will be returned by way of line 32, to the sump. However, some of this fluid will be returned, by way of the branch line 60, to the radial port of the venturi device 64, and will re-enter the high pressure line 30 directly. The advantage of this arrangement is as follows:

During an initial part of the pumping cycle, when resistance to flow of slurry from the apparatus into the filter press is minimal, the piston 18 will downstroke at a rapid rate, and thus fluid will flow from the lower inlet port 16*b* of the operating device at a high flow rate. The speed of flow of fluid under pressure along line 30 during this part of the pumping cycle is sufficient to enable up to 30% of the fluid exiting from the cylinder 16 to be returned directly to the high pressure line 30, without significant pressure loss in the high pressure line 30. By this means, fluid under sufficient pressure to carry out the pumping cycle during an initial sequence of pumping strokes may be provided, by means of a fluid pressure motor which is capable of delivering fluid at a flow rate less than that which is theoretically required, to sustain the pumping operation at its maximum rate.

When the magnetic element 38 reaches a position adjacent to the lower limit switch 44, the proximity of the magnet to the switch 44 causes the switch 44 to close, and (since switch S1 is closed) causes a brief energisation of the solenoid 34 to move the valve 28 to its second position. Closure of the lower limit switch 44 similarly energises relay R1 (which may if desired be time-delayed) which opens switch S1 and closes switch S2.

With the valve mechanism 28 in its second position, fluid under pressure is provided through the lower port of the cylinder 16, forcing the drive piston to upstroke, causing in turn the pumping piston 18 to draw fluid from source through the inlet valve 10 into the cylinder chamber 12.

It will of course be appreciated that, during the intake stroke of the pumping apparatus, the one-way valve 62 operative across line 60 prevents flow of fluid under pressure into the cylinder 16 through the lower inlet port 16*b*, and that, during the intake stroke, there is no "regenerative" recirculation of fluid from the low pressure side of the fluid circuit directly back into the high pressure side of the circuit.

When the cross-head 8 reaches a position in which the magnetic element 38 is adjacent to the upper limit switch 42, the proximity of the said magnet to the reed switch causes the reed switch 42 to close. Since the switch S2 is also closed, this causes energisation for a brief period of the solenoid 36, which causes the valve mechanism to return to its first position. However, closing of the upper limit switch 42 also energises relay R2, which opens switch S2 and closes switch S1.

In the use of the apparatus, an alternating sequence of pumping and intake steps is repeated, until the filter press approaches a condition in which it is substantially filled. In such a condition, flow of fluid under pressure through line 30 and through the venturi device 64 is insufficient to generate any significant "pull" of the fluid along line 60, and valve 62 becomes in effect closed. As the pressue detected in line 56, on a pumping cycle of the apparatus, approaches a predetermined maximum a gauge 72 is operated, and is effective to cut out the electrical control of the valve mechanism 28, and the by-pass line 74, together with the restrictor 76 and one-way valve 78 operative therein, is effective to centralise the spool of the valve mechanism 28. In its centralised position, the valve provides for significantly reduced flow of fluid under pressure from line 30 to line 56, and significantly reduced flow of fluid from line 58 to line 32.

However, the pressure at which the gauge 72 is operative, is also effective to open the relief valve 66, allowing fluid to flow directly from line 58 to the sump 27 preferentially directly.

Thus, upon reaching stall condition, some flow of fluid under pressure from line 30 to line 56 is permitted, to maintain the pressure on the drive piston 18, to maintain the filter press firmly packed.

Should the apparatus stall with the magnet 38 adjacent to one or other of the limit switches 42 and 44, by the use of the relays R1 and R2 neither of the two solenoids 34 or 36 will be continuously energised.

Figure 2:
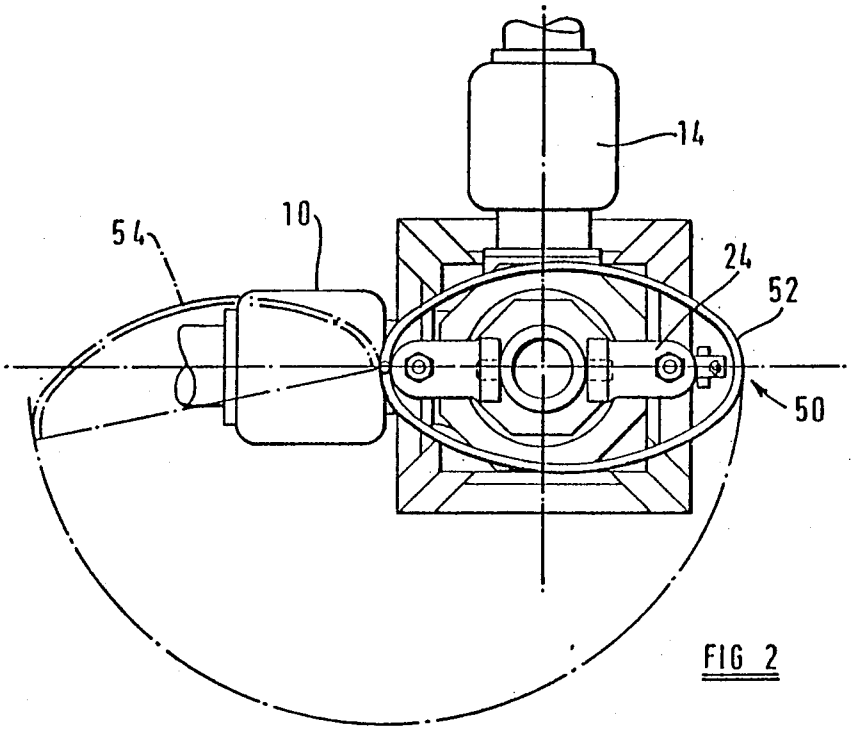
FIG. 2 is a plan view of the apparatus, part having been omitted for clarity.
Figure 3:
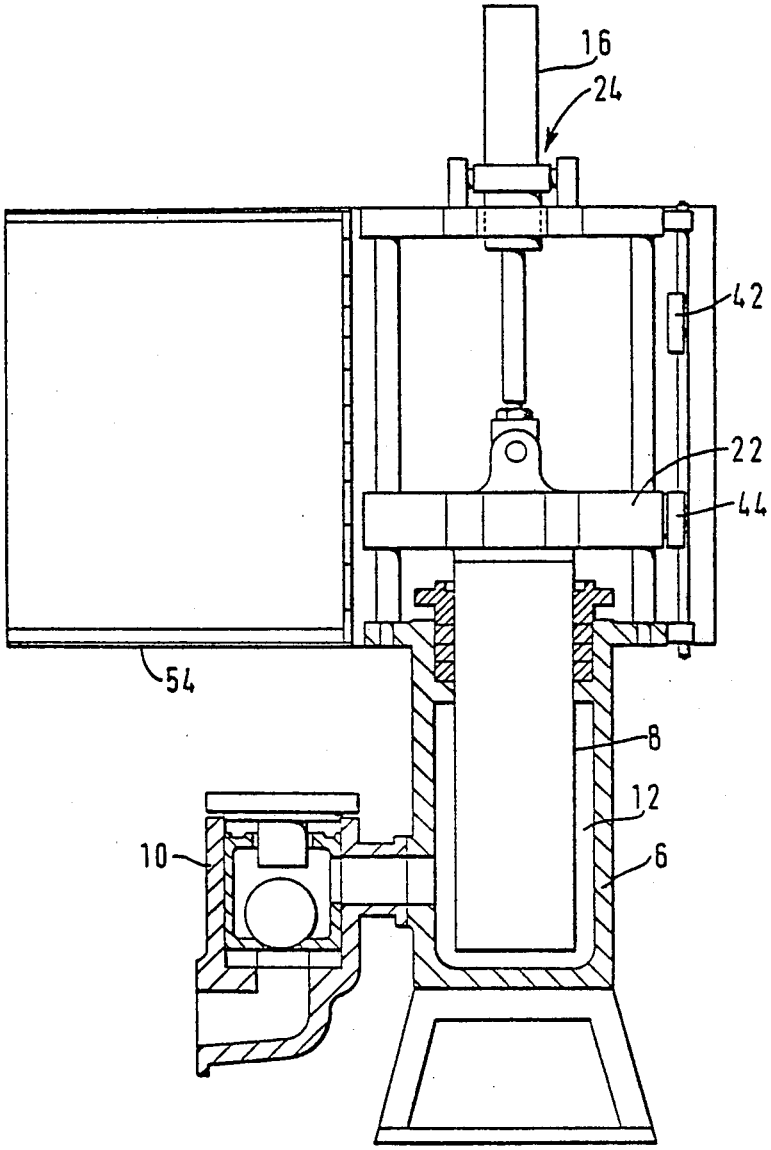
FIG. 3 is a vertical sectional view taken on the line A—A of FIG. 2.

The apparatus comprises a guard in the form of a safety screen 50, comprising two curved sections 52 and 54, which may be of transparent, reinforced plastics material or may be wire mesh. Advantageously the section 54 is mounted for pivotal movement, and may be opened (as shown in FIG. 2) should acceptance to the interior be requires. Advantageously, the door is interlocked with the control mechanism, so that operation of the apparatus is shut down, when the door is opened.

I claim:

1. Apparatus for use in the pumping of a slurry and comprising a pumping device comprising a cylinder and a piston mounted therein, and which is operative to cause liquid to be drawn through an inlet port and expelled through an outlet port, an operating device comprising a cylinder and a piston mounted therein, a fluid pressure circuit which includes a fluid sump, a pump operative to pump fluid under pressure to the operating device, and valve mechanism operative to control the admission of fluid under pressure to the operating device, a connecting member extending between the piston of the pumping device and the piston of the operating device, wherein in each pumping operation of the apparatus, part of the fluid flowing from the low pressure side of the operating device is returned thereto through a venturi device directly to the high pressure side of the fluid circuit, and part is returned to the sump of the fluid pressure circuit.

2. Apparatus according to claim 1 wherein there is provided in the low pressure side of the operating device, a valve which is normally in a first condition in which part of the fluid flowing from the low pressure side of the operating device is returned directly to the high pressure side of the fluid circuit and part is returned to the sump of the fluid circuit, said valve being moved from its first condition to a second condition in consequence of an increase in the pressure of fluid on the high pressure side of the operating device to a predetermined pressure, in which second condition fluid flowing from the low pressure side of the operating device is returned preferentially directly to the sump of the fluid pressure circuit.

3. Apparatus for use in the pumping of a slurry and comprising a pumping device comprising a cylinder and a piston mounted therein, and which is operative to cause liquid to be drawn through an inlet port of the cylinder and expelled through an outlet port thereof, an operating device comprising a cylinder and a piston mounted therein, a fluid pressure circuit which includes a fluid sump, a pump operative to pump fluid under pressure to the operating device, and valve mechanism operative to control the admission of fluid under pressure to the operating device, and a connecting member extending between the piston of the pumping device and the piston of the operating device, wherein during an initial part of each pumping operation of the apparatus, part of the fluid flowing from the low pressure side of the fluid pressure circuit is returned directly to the high pressure side of the fluid pressure circuit, and part is returned to the sump of the fluid pressure circuit.

4. Apparatus according to claim 3 wherein the said part of the fluid which is returned directly to the high pressure side of the fluid pressure circuit, is returned thereto through a venturi device.

5. Apparatus according to claim 3 wherein there is provided in the low pressure side of the operating device, a valve which is normally in a first condition in which part of the fluid flowing from the low pressure side of the operating device is returned directly to the high pressure side of the fluid circuit and part is returned to the sump of the fluid circuit, said valve being moved from its first condition to a second condition in consequence of an increase in the pressure of fluid on the high pressure side of the operating device to a predetermined pressure, in which second condition fluid flowing from the low pressure side of the operating device is returned preferentially directly to the sump of the fluid pressure circuit.

6. Apparatus according to claim 3, comprising a device in the fluid circuit which is responsive to an increase in the pressure of the circuit during a pumping stroke of the apparatus towards a predetermined maximum to move the valve mechanism to an intermediate condition in which fluid under pressure delivered thereto is returned thereby directly towards the sump.

7. Apparatus according to claim 3 including a control mechanism having an actuator member fixably secured in relation to the connecting member and two sensor members mounted at spaced positions adjacent to the path along which the actuator member travels upon reciprocation of the connecting member, each sensor member being responsive to movement of the actuator member into an extreme position adjacent thereto to cause switching of the valve mechanism.

8. Apparatus according to claim 7 wherein the sensor members are provided by proximity switches mounted alongside the path of travel of the actuator member whereby direct mechanical interaction or connection between the proximity switches and the actuator member is avoided in achieving said switching.

9. Apparatus according to claim 8 wherein the proximity switches are provided by reed switches, and the actuator member is provided by a permanent magnet fixedly secured to the connecting means.

10. Apparatus according to claim 8 wherein each of the proximity switches is responsive to change in electrical capacitance produced by movement of the actuator member into a position alongside the switch.

11. Apparatus according to claim 8 wherein switching of the valve mechanism upon actuation of the proximity switches is time-delayed.

12. Apparatus according to claim 8 wherein the connecting means comprises a connecting member extending between the piston of the pumping device and the piston of the operating device, and a cross head secured to the connecting member, the cross head being guided for linear movement parallel to the axes of the cylinders by tie rods passing through apertures in the cross head, the actuator member being mounted on a radially outer part of the cross head.

* * * * *